US009409733B2

(12) United States Patent
Arakane et al.

(10) Patent No.: US 9,409,733 B2
(45) Date of Patent: Aug. 9, 2016

(54) CONVEYING APPARATUS AND PRINTING APPARATUS

(71) Applicant: BROTHER KOGYO KABUSHIKI KAISHA, Nagoya, Aichi (JP)

(72) Inventors: Satoru Arakane, Aichi (JP); Yuki Matsui, Kiyosu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/670,491

(22) Filed: Mar. 27, 2015

(65) Prior Publication Data

US 2015/0274456 A1 Oct. 1, 2015

(30) Foreign Application Priority Data

Mar. 28, 2014 (JP) ..... 2014-067728

(51) Int. Cl.

*B65H 3/44* (2006.01)
*B65H 7/06* (2006.01)
*B65H 3/06* (2006.01)

(52) U.S. Cl.

CPC ..... *B65H 3/44* (2013.01); *B65H 3/0684* (2013.01); *B65H 7/06* (2013.01); *B65H 3/0661* (2013.01); *B65H 2402/46* (2013.01); *B65H 2404/6111* (2013.01); *B65H 2405/324* (2013.01); *B65H 2405/3322* (2013.01); *B65H 2407/21* (2013.01); *B65H 2511/414* (2013.01); *B65H 2511/51* (2013.01); *B65H 2513/53* (2013.01); *B65H 2551/20* (2013.01); *B65H 2553/82* (2013.01)

(58) Field of Classification Search

CPC .... B65H 3/0661; B65H 7/06; B65H 2407/21; B65H 2511/414; B65H 2513/53

See application file for complete search history.

(56) References Cited

U.S. PATENT DOCUMENTS

| | | | | |
|---|---|---|---|---|
| 7,478,804 | B2 * | 1/2009 | Yamada | B65H 1/26 271/9.08 |
| 2004/0061273 | A1 | 4/2004 | Yamada et al. | |
| 2004/0217541 | A1 * | 11/2004 | Horio | B65H 3/46 271/121 |
| 2005/0285327 | A1 * | 12/2005 | Suzuki | B65H 3/0661 271/109 |

FOREIGN PATENT DOCUMENTS

| | | | |
|---|---|---|---|
| JP | 2004-123238 | A | 4/2004 |

* cited by examiner

*Primary Examiner* — Howard Sanders
(74) *Attorney, Agent, or Firm* — Scully, Scott, Murphy & Presser, PC

(57) ABSTRACT

A conveying apparatus has first and second trays arranged on an upstream of a conveyor and configured to support the sheet in contact with the conveyor, a feeder configured to feed the sheet on the first tray toward the conveyor, a first sensor configured to output a first signal in response to the sheet being present on the first tray, a second sensor configured to output a second signal in response to the sheet being present between the first tray and the conveyor and configured to output the second signal in response to the sheet being present between the second tray and the conveyor, and a controller configured to execute a removal notifying process to output a notification indicating removal of the sheet on the first tray in response to output of the second signal before a time period since the first signal was output exceeds a threshold period.

9 Claims, 11 Drawing Sheets

12
11
22
37
34
36
24
23
39
60
63
65
55
125
31
35
31A
61
54
40
42
21
62
120
65
18
19
16
UP
7
DOWN
25
26
27
12
15
8
REAR
FRONT
20

12
11
22
37
34
36
24
23
39
60
63
65
55
125
31
35
31A
61
54
40
42
21
62
120
65
18
19
16
UP
7
DOWN
25
26
27
12
15
8
REAR
FRONT
20

CONVEYING APPARATUS AND PRINTING APPARATUS

This application claims priority under 35 U.S.C. §119 from Japanese Patent Application No. 2014-067728 filed on Mar. 28, 2014. The entire subject matter of the application is incorporated herein by reference.

BACKGROUND

1. Technical Field

The present disclosures relate to a conveying apparatus and a printing apparatus.

2. Related Art

Conventionally, there have been known printing apparatuses configured to print images on sheets supported by a plurality of trays, respectively. Among such printing apparatuses, there exists a printing apparatus which is provided with a sheet holder configured to support a plurality of stacked sheets and a manual-feeding tray configured to support a sheet which is manually inserted, in the printing apparatus, to a position of a sheet detection sensor.

Such a printing apparatus is configured to operate a conveying roller of the printing apparatus to transport the sheet supported on the manual-feeding tray to a position where the sheet faces a printing head in response to receiving the print instruction on the condition that the sheet detection sensor being ON. The printing apparatus may be further configured to operate a feed roller of the printing apparatus to feed a sheet on the sheet placement plate until the sheet reaches the conveying roller.

SUMMARY

According to aspects of the disclosures, there is provided a conveying apparatus, which has a conveyor configured to convey a sheet in a conveying direction conveyor, a first tray arranged on upstream, in the conveying direction, of the conveyor and configured to support the sheet thereon, a second tray arranged on upstream, in the conveying direction, of the conveyor and configured to support the sheet which in contact with the conveyor, a feeder configured to feed the sheet on the first tray toward the conveyor, a first sensor configured to output a first signal in response to the sheet being present on the first tray, a second sensor configured to output a second signal in response to the sheet being present between the first and second trays and the conveyor and configured to output the second signal in response to the sheet being present between the second tray and the conveyor, and a controller configured to receive both of output of the first signal and output of the second signal. Further, the controller is further configured to execute a removal notifying process to output a notification indicating removal of the sheet on the first tray when the first signal has been output and in response to output of the second signal before a time period since the first signal was output exceeds a threshold period.

According to further aspects of the disclosures, there is provided a printing apparatus, which has the conveying apparatus as described above, and a printing mechanism configured to print an image on the sheet conveyed by the conveyor. The printing apparatus further has a controller configured to receive both of output of the first signal and output of the second signal and configured to operate the feeder, the conveyor, and the printing mechanism based on the first signal and the second signal, the controller configured to execute, a receiving process to receive a print instruction which instructs printing of an image on a sheet corresponding to the sheet on the first tray, a first notifying process to notify that a sheet is not on the first tray in response to the first signal not being output when the controller receives the print instruction, and a second notifying process, to output a notification indicating removal of the sheet on the first tray, in response to the first signal having been output after execution of the first notifying process and the second signal having been output before a period of time since the first signal was output exceeds the threshold period.

BRIEF DESCRIPTION OF THE ACCOMPANYING DRAWINGS

DETAILED DESCRIPTION OF THE EMBODIMENT

Hereinafter, referring to the accompanying drawings, an illustrative embodiment according to aspects of the disclosures will be provided. It should be noted that the illustrative embodiment described hereinafter is merely an example and various modification may be realized without departing from the aspects of the disclosures.

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storages, hard disk drives, floppy drives, permanent storages, and the like.

Figure 1:
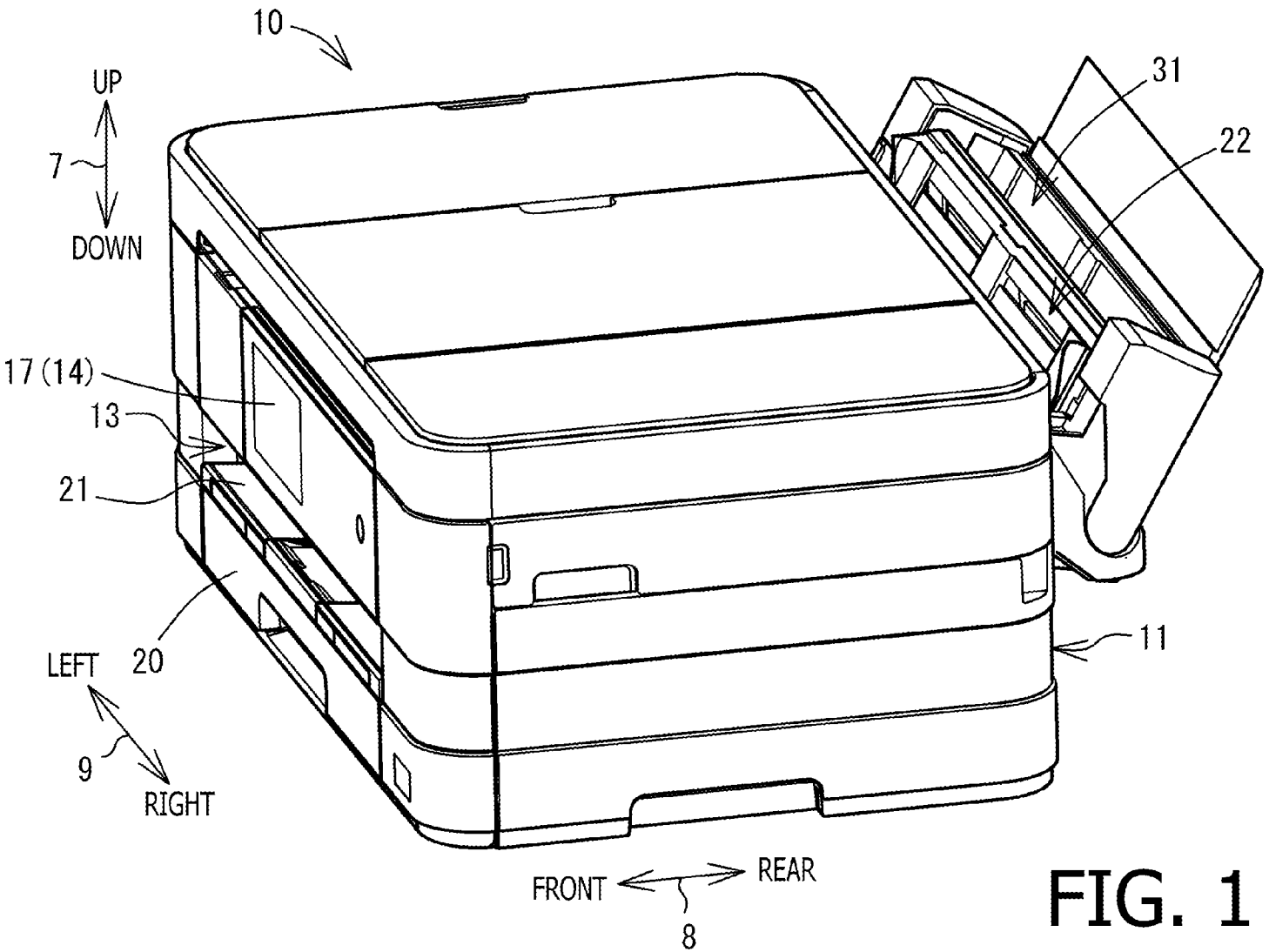
FIG. 1 is a perspective view of an MFP (multi-function peripheral) according to an illustrative embodiment of the disclosures.

In the following description and drawings, directions will be defined such that up and down directions are defined with respect an MFP (multi-function peripheral) 10 placed for use as shown in FIG. 1. Further, a direction on which an opening 13 is formed on a casing of the MFP 10 is defined as a front side of the MFP 10, an opposite side is defined as a rear side, and right and left sides when the MFP 10 is viewed from the front side are defined as right and left sides of the MFP 10, respectively. In the following description, an up-and-down direction 7, a front-and-rear direction 8 and a right-and-left direction 9 are defined based on the above definitions.

The MFP 10 has a substantially cuboids outer shape as shown in FIG. 1. The MFP 10 has various functions such as a facsimile transmission function and a printing function. The MFP 10 has a printer 11 provided on a lower part thereof The printer 11 is configured to print images on sheets 12 in accordance with an inkjet printing method. According to the illustrative embodiment, the printer 11 conveys the sheet 12 and ejects ink drops on the sheet being conveyed, thereby printing an image on the sheet 12. The MFP 10 also has a display unit 14 and an console 17. The printer 11 is, as shown in FIG. 2, provided with a first feeder 15, a second feeder 34, a feeding tray 20, a multi-purpose tray (hereinafter, also referred to as an MP tray) 31, a manual-feeding tray 22, a discharging tray 21, a conveying roller unit 54, a printing mechanism 24, a discharging roller unit 55, a platen 42.

Figure 2:
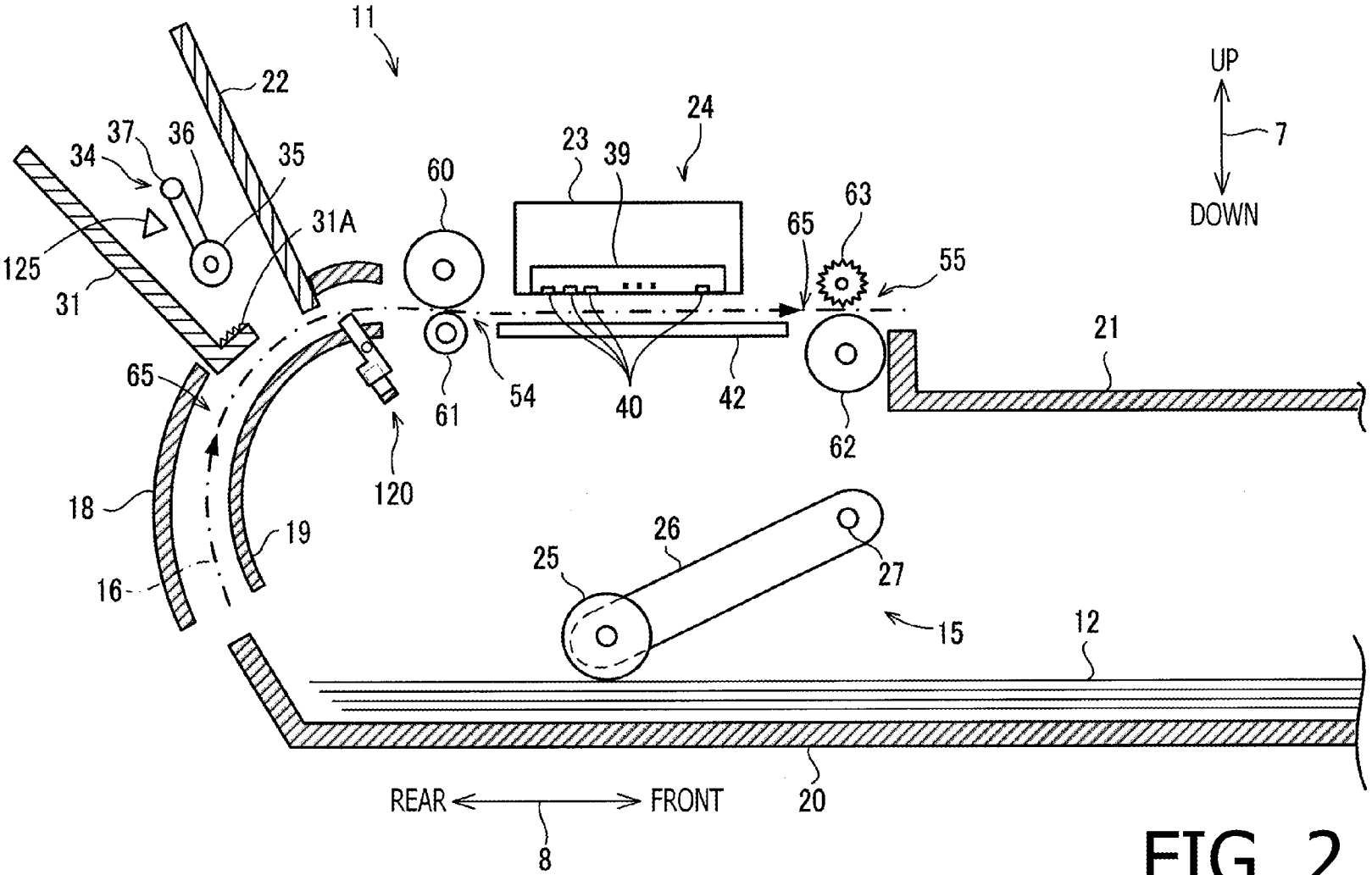
FIG. 2 is a cross-sectional side view of a printer section of the MFP according to the illustrative embodiment of the disclosures.

As shown in FIG. 1, an opening 13 is formed on the front surface of the printer 11, and the feeding tray 20 is configured to be slidably attached to and removed from the printer 11, in the front-and-rear direction, through the opening 13 by a user (see FIGS. 1 and 2). The feeding tray 20 is configured to support a plurality of sheets 12 which are stacked inside the feeding tray 20. The discharging tray 21 is arranged above the feeding tray 20. The discharging tray 21 is to support the sheets 12 discharged through the opening 13 by the discharging roller unit 55.

The manual-feeding tray 22 (an example of a second tray) is, as shown in FIGS. 1 and 2, arranged to incline upward and rearward from the rear surface of the printer 11. The manual-feeding tray 22 is configured to support one sheet 12 on its upper surface. The sheet 12 on the manual-feeding tray 22 reaches the conveying roller unit 54 passing a position where a registration sensor 12 (described later) is provided. In other words, the manual-feeding tray 22 supports the sheet 12 which is in contact with the conveying roller unit 54.

As shown in FIGS. 1 and 2, the MP tray 31 (an example of a first tray) is arranged to extend rearward and incline upward from the rear surface of the printer 11. The MP tray 31 supports a plurality of sheets 12 in a stacked manner. The MP tray 31 is provided with a separation piece 31A(an example of a separation mechanism), which is a kind of a separation mechanism. Leading ends of the sheets 12 supported by the MP tray 31 may contact the separation piece 31A. The separation piece 31A has a plurality of teeth formed to have a plurality of convex and concave portions in a direction intersecting with the supporting surface of the MP tray 31. The separation piece 31A separates one sheet 12 from the other sheets 12 stacked on the MP tray 31. The thus separated sheet 31 is fed toward the conveying roller unit 54.

As shown in FIG. 2, the first feeder 15 has a first feeding roller 25, a feeding arm 26, and a shaft 27. The first feeding roller 25 is rotatably supported at a tip end of the feeding arm 26. When the conveying motor 102 (see FIG. 5) reversely rotates, the first feeding roller 25 rotates in a direction to convey the sheet 12 on the feeding tray 20 in the conveying direction (which will also be referred to as a forward direction). The feeding arm 26 is rotatably supported by the shaft 27 which is supported by the frame of the printer 11. The feeding arm 26 is rotatably urged toward the feeding tray 20 by an elastic force of its dead weight or by an elastic force generating member such as a spring.

The second feeder (an example of a feeder) 34 feeds a top sheet 12 of the stack of sheets 12 on the MP tray 31 so as to reach the conveying roller unit 54 via a position at which the registration sensor 120 is arranged. At this stage, the sheets 12 of the stacked sheets on the MP tray 31 and below the fed sheet 12 are not stay on the MP tray 31 without being drawn by the top sheet 12. A second feeding roller 35 (an example of a feed roller), a feeding arm 36 and a shaft 37 are similar to the first feeding roller 25, the feeding arm 26 and the shaft 27 of the first feeder 15, respectively, and description thereof will not be repeated for brevity.

A conveying path 55 is a path in which the sheet 12 is conveyed. A part of the conveying path 55 is a space defined by, inside the printer 11, an outer guide member 18 and inner guide member 19 as shown in FIG. 2. The conveying path 55 extends from a rear end of the feeding tray 20 (hereinafter, also referred to as a starting end of the conveying path 65) to the discharging tray 21. According to the illustrative embodiment, the conveying path 65 has a curved path which extends, on the rear side of the printer 11, upward with making a U-turned portion, and a linear path which extends from an upper end (i.e., a downstream end in the conveying direction) of the curved path. In FIG. 2, the conveying direction of the sheet in the conveying path 65 is indicated by dotted lines with an arrow in FIG. 2.

The sheet 12 on the feeding tray 20 is fed by the first feeder 15 and enters the conveying path 65 from its starting end, and is conveyed along the conveying direction 16. The sheet 12 on the MP tray 31 is fed by the second feeder 34 and enters the conveying path 65 at a position which is on the downstream side, in the conveying direction 16, with respect to the staring end, and is on the upstream side with respect to the registration sensor 120, and then is conveyed in the conveying direction 16. The sheet 12 on the manual-feeding tray 22 enters the conveying path 65 at a position on the downstream side, in the conveying direction 16, with respect to the starting end and on the upstream side with respect to the registration sensor 120, and reaches the conveying roller unit 54.

As described above, according to the illustrative embodiment, the sheet 12 on the MP tray 31 or the manual-feeding tray 22 enters the conveying path 65 at a position on the curved path side (i.e., on the upstream side in the conveying direction 16) with respect to a boundary between the curved path and the linear path. It is noted that, if the printing mechanism 24 is arranged more frontward in comparison with a position thereof shown in FIG. 2, the MP tray 31 and the manual-feeding tray 22 may be arranged such that the sheet 12 on the MP tray 31 or the manual-feeding tray 22 directly enters the linear path.

The conveying roller unit 54 (an example of a conveyor) is arranged on the upstream side, in the conveying direction 16, with respect the printing mechanism 24 as shown in FIG. 2. The conveying roller unit 54 includes a conveying roller 60 and a pinch roller 61 which face each other. The sheet 12 is nipped by the conveying roller 60 and pinch roller 61, and conveyed in the conveying direction 16 as the conveying motor 102 is forwardly rotated to forwardly rotate the conveying roller 60

The discharge roller unit 55 is arranged on the downstream side, in the conveying direction 16, with respect to the printing mechanism 24, as shown in FIG. 2. The discharge roller unit 55 has a discharging roller 62 and a spur roller 63 which face each other. The sheet 12 is nipped by the discharging roller 62 and the spur roller 63, and conveyed in the conveying direction 16 as the conveying roller 102 is forwardly rotated to forwardly rotate the discharging roller 62.

The printer 11 has the registration sensor 120 (an example of a second sensor) on the upstream side, in the conveying direction 16, with respect to the conveying roller unit 54. According to the illustrative embodiment, the registration sensor 120 is arranged at around a boundary between the curved path and the linear path. Also the registration sensor 120 is arranged at between the MP tray 31 and the conveying roller unit 54 and at the between the manual-feeding tray 22 and the conveying roller unit 54. The registration sensor 120 is for detecting absence/presence of the sheet 12 at a detection position located at around the boundary between the curved path and the linear path. Each of the sheets 12 conveyed by the first feeder 15, the sheet 12 conveyed by the second feeder 34, the sheet 12 on the manual-feeding tray 22 passes the detection position of the registration sensor 120 and reaches the conveying roller unit 54.

The registration sensor 120 outputs a low level signal (an example of the second signal) in response to detection of presence of the sheet 12 at the detection position. The low level signal output by the registration sensor 120 is transmitted to a controller 130 (see FIG. 5). In response to detection of absence of the sheet 12 at the detection position, the registration sensor 120 outputs a high level signal to the controller 130. In the following description, a state where the registration sensor 120 is outputting the low level signal will be referred to as a registration-active state, while a state where the registration sensor 120 is outputting the high level signal will be referred to as a registration-non-active state.

The printer 11 has a rotary encoder 121 configured to generate a pulse signal in accordance with a rotation of the conveying roller 60 (i.e., rotation of the conveying motor 102). The rotary encoder 121 has an encoder disc and an optical sensor. The encoder disc is configured to rotate together with the conveying roller 60. The optical sensor is configured to read the rotating encoder disc, generates the pulse signal, and transmits the thus generated pulse signal to the controller 130.

The printer 11 has a tray sensor 125 (an example of the first sensor) for detecting whether the sheet 12 is on the MP tray 31. The tray sensor 125 transmits a low level signal (an example of the first signal) when the sheet 12 is on the MP tray 31, while transmits a high level signal when the sheet 12 is not on the MP tray 31. In the following description, a state where the tray sensor 125 is outputting the low level signal will be referred to as an MP-active state, while a state where the tray sensor 125 is outputting the high level signal will be referred to as a MP-non-active state.

Figure 3:
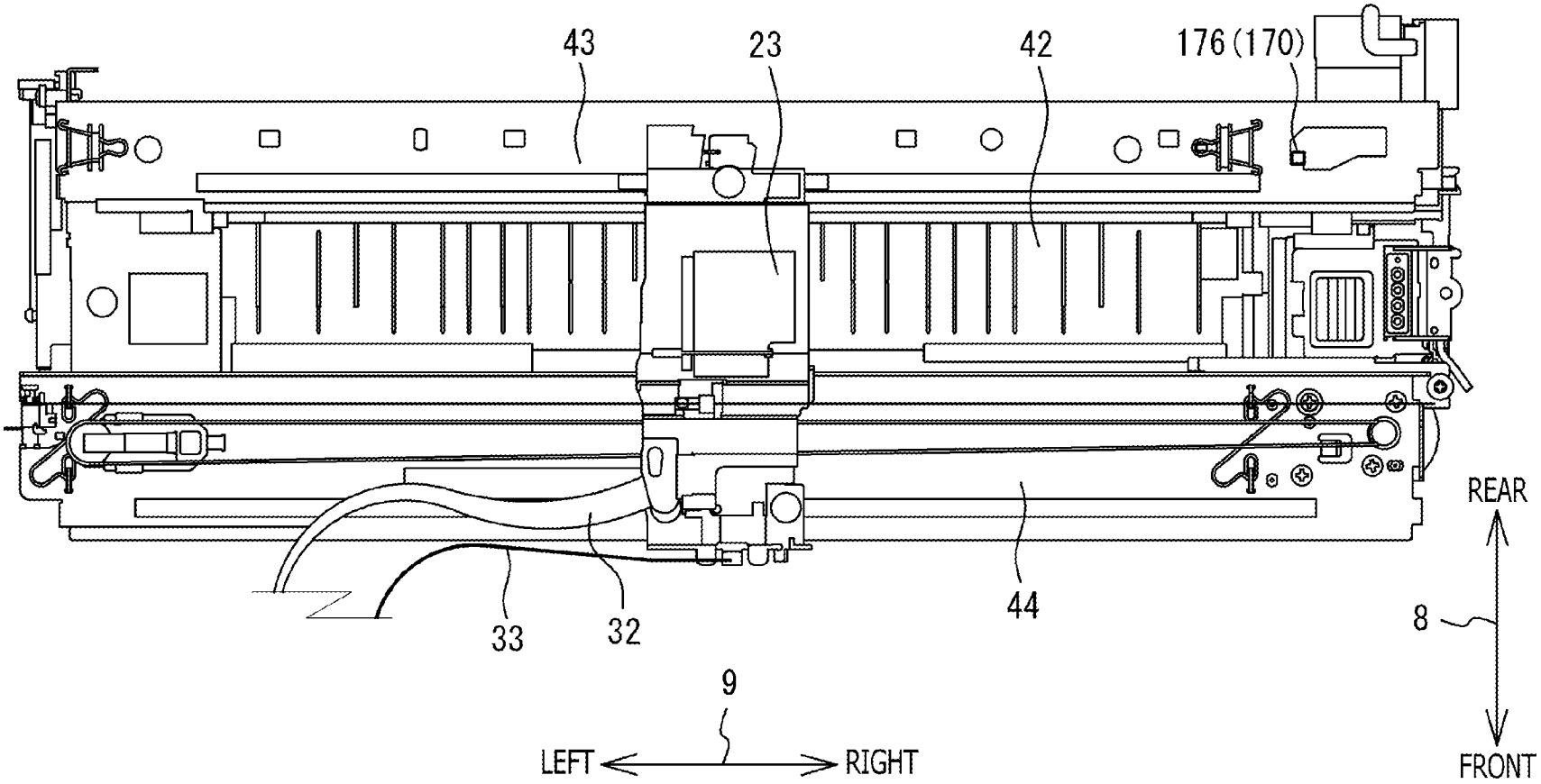
FIG. 3 is a plan view of a carriage and guide rails according to the illustrative embodiment of the disclosures.

The printing mechanism 24 is arranged between, in the conveying direction, the conveying roller unit 54 and the discharging roller unit 55. Further, the printing mechanism 24 is arranged to face, in the up-and-down direction, the platen 42. The printing mechanism 24 has a carriage 23 and a printing head 39. Further, from the carriage 23, as shown in FIG. 3, an ink tube 32 and a flexible flat cable 33 are extended. The ink tube 32 supplies ink for the ink cartridge to the printing head 39. The flexible flat cable 33 electrically connects the printing head 39 with a control circuit substrate on which the controller 130 is implemented.

As shown in FIG. 3, the carriage 23 is supported on guide rails 43 and 44, which are arranged to be spaced in the front-and-rear direction from each other and extend in the right-and-left direction 9. The carriage 23 is connected to a well-known belt mechanism provided to the guide rail 44. The belt mechanism is driven by the carriage motor 103 (see FIG. 8). That is, the carriage 23 is connected to the belt mechanism which is driven by the carriage motor 103 to circularly move, thereby the carriage 23 being moveable in a main scanning direction which is the right-and-left direction 9 reciprocally by driving the carriage motor 103.

The printing head 39 is mounted on the carriage 23 as shown in FIG. 2. On a bottom surface of the printing head 39, a plurality of nozzles 40 are formed, and the printing head 39 ejects ink drops through the plurality of nozzles 40. In a process of moving the carriage 23, the ink drops are landed to the sheet 12 on the platen 42, thereby an image being printed on the sheet 12.

The platen 42 is arranged between, in the conveying direction, the conveying roller unit 54 and the discharging roller unit 55, as shown in FIG. 2. The platen 42 is arranged to face, in the up-and-down direction, the printing mechanism 24, and support the sheet 12 which is conveyed by the conveying roller unit 54 from below.

Figure 5:
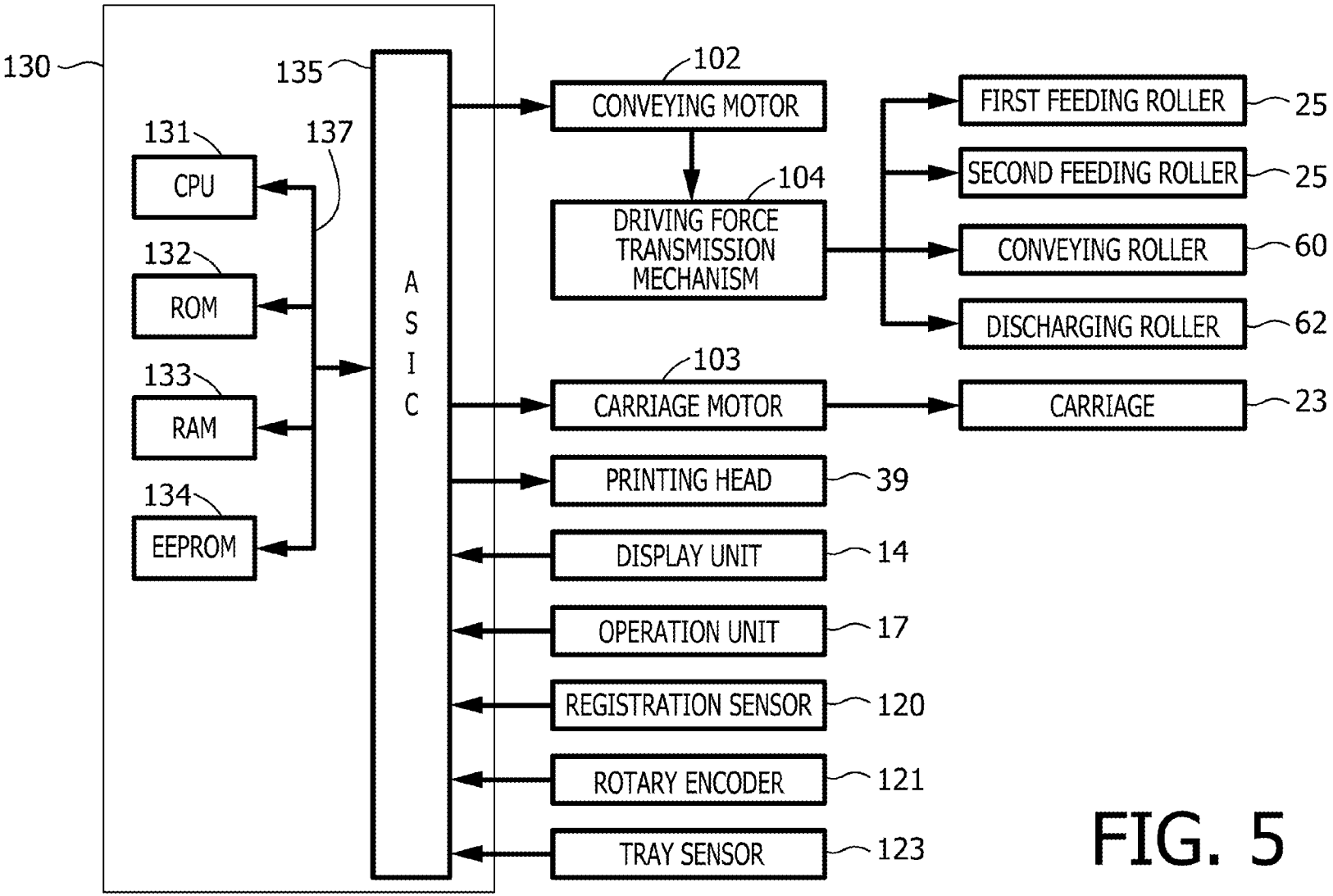
FIG. 5 is a block diagram of the printer section according to the illustrative embodiment of the disclosures.

A driving force transmitting mechanism 104 shown in FIG. 5 is configured to transmit the driving force of the conveying motor 102 to the first feeding roller 25, the second feeding roller 35 and the discharging roller 62. The driving force transmitting mechanism 104 has a switching mechanism 170 used to switch destinations of the driving forces of the conveying motor 102. It is noted that an actual mechanism to switch the destination of the driving force need not be limited to the configuration described below.

According to the illustrative embodiment, the switching mechanism 170 is configured to realize two sate: a first driving state in which the driving force of the conveying motor 102, which is transmitted through the conveying roller 60, is transmitted to the first feeding roller 25 and is not transmitted to the second feeding roller 35; and a second driving state in which the driving force of the conveying motor 102 is transmitted to the second feeding roller 25 and is not transmitted to the first feeding roller 35. The switching mechanism 170 is provided with, as shown in FIG. 4, a switching gear 171, two receiving gears 172A and 172B, a holding part 173, a pressing member 175 and a switching lever 176.

The switching gear 171 is configured to be rotatable about a supporting shaft 174, and movable in a direction where the supporting shaft 174 extends (i.e., in the right-and-left direction 9). The driving force of the conveying motor 102 is transmitted to the switching gear 171 through the conveying roller 60. The receiving gears 172A and 172B are configured to rotatable about the same rotating axis extending in the right-and-left direction 9 below the supporting shaft 174, and engageable with the switching gear 171. In other words, the switching gear 171 move in the right-and-left direction 9 and engages with one of the receiving gears 172A and 172B. The receiving gear 172A is for transmitting the driving force of the conveying motor 102 to the first feeding roller 25, while the receiving gear 172B is for transmitting the driving force of the conveying motor 102 to the second feeding roller 35.

The pressing member 175 is arranged on a right side of the switching gear 171, and fitted on the supporting shaft 174 such that the pressing member 175 is slidable in the right-and-left direction 9. The switching lever 176 protrudes upward from the pressing member 175, and extends to a moving path of the carriage passing the holding part 173. The switching gear 171 is urged rightward by a first spring, and the pressing member 175 is urged leftward by a second spring. The urging force of the second spring is greater than that of the first spring. As a result, the switching gear 171 and the pressing gear 175 are urged leftward (see FIGS. 4A and 4B).

Figure 4A:
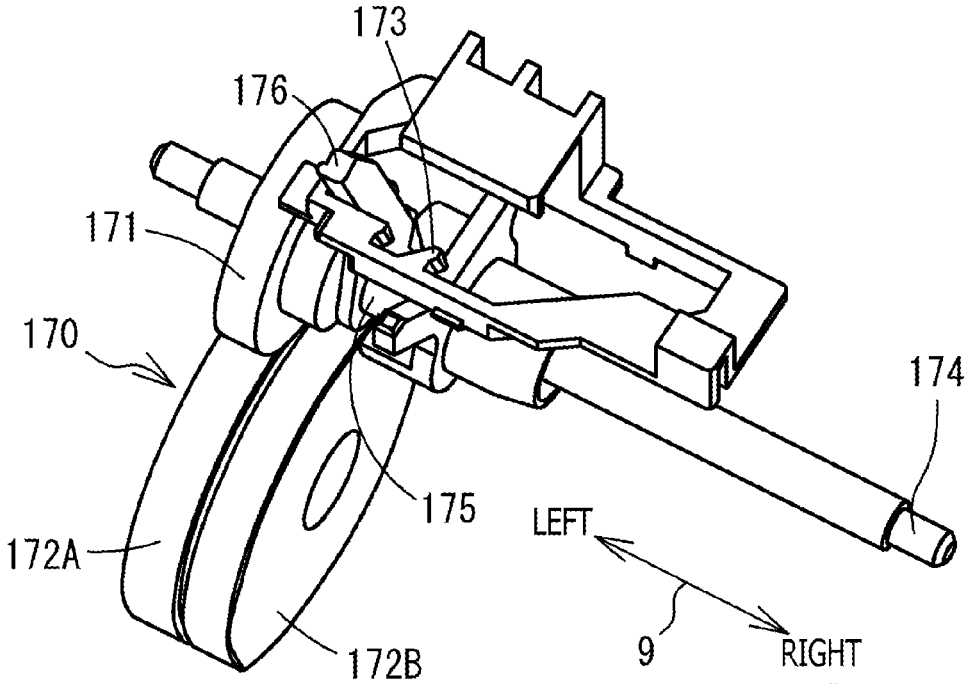
FIG. 4A is a perspective view of a switching mechanism according to the illustrative embodiment and when a switching lever is located at a first position.
Figure 4B:
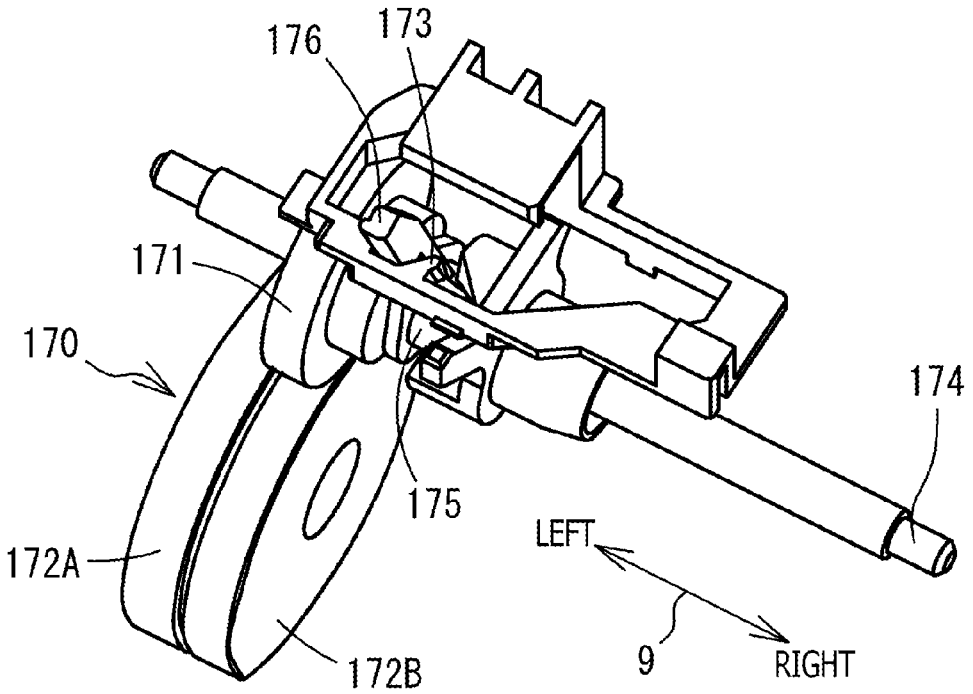
FIG. 4B is a perspective view of the switching mechanism according to the illustrative embodiment and when the switching lever is located at a second position.

When the switching lever 176 is held, by the holding part 173, at a first position shown in FIG. 4A, the switching gear 171 engages with the receiving gear 172A. The switching lever 176 contacts the carriage 23 which moves rightward, moves the pressing member 175 rightward. At this stage, by the urging force of the first spring, the switching gear 171 moves rightward in association with movement of the pressing member 175. When the switching lever 176 is held at the second position, which is shown in FIG. 4B, by the holding part 173, the switching gear 171 engages with the receiving gear 172B. Further, when the switching lever 176 is moved, by the carriage 23, to the right end of the holding part 173, and the carriage 23 is spaced from the switching lever 176, the switching lever 176 returns to the first position, which is shown in FIG. 4A, by the urging force of the second spring.

When the switching gear 171 engages with the receiving gear 172A (i.e., in the first driving state shown in FIG. 4A), the driving force transmitting mechanism 104 transmits the driving force of the conveying motor 102 to the first feeding roller 25, but not to the second feeding roller 35. When the switching gear 171 engages with the receiving gear 172B (i.e., in the second driving state shown in FIG. 4B), the driving force transmitting mechanism 104 transmits the driving force of the conveying motor 102 to the second feeding roller 35, but not to the first feeding roller 25.

The driving force transmitting mechanism 104 does not transmit the forward-rotation driving force of the conveying motor 102 to the first feeding roller 25, but transmits the reverse-rotation driving force of the conveying motor 102 to the first feeding roller 25, which rotates forwardly. Transmission of the driving force to the second feeding roller 35 is same as the transmission of the driving force to the first feeding roller 25.

The display unit 14 has a display screen which shows information to be notified to the user as messages and/or animations. It is noted that the actual configuration of the display unit 14 need not be limited to a specific one. For example, an LCD (liquid crystal display), and an Organic EL display (organic electro-luminescence display) may be employed for the display unit.

The console 17 is an input interface which receives user's inputs of instructions to the MFP 10. The configuration of the console 17 needs not be limited to a specific one. For example, the console 17 may have a plurality of depression buttons, or as shown in FIG. 1, the console 17 may have a touch sensor overlaid on the display screen of the display unit 14.

The controller 130 includes, as shown in FIG. 5, a CPU (central processing unit) 131, a ROM (read only memory), a RAM (random access memory) 133, an EEPROM (electrically-erasable ROM) 134, and an ASIC (application-specific integrated circuit) 135, which are interconnected through an internal bus 137. The ROM 132 stores various programs which cause, when executed, the CPU 131 to perform various operations. The RAM 133 is used as a storage for temporarily storing data/signal data corresponding to signals which are used when the CPU 131 executes the programs and/or a work area for data processing. The EEPROM 134 stores settings, flags and the like which should be retained even if the MFP 10 is powered off.

To the ASIC 135, the conveying motor 102 and the carriage motor 103 are connected. The ASIC 135 generates drive signals for rotating the conveying motor 102 and the carriage motor 103, respectively, and controls the conveying motor 102 and the carriage motor 103 based on the drive signals. Each of the conveying motor 102 and the carriage motor 103 rotates forwardly or reversely based on the drive signal transmitted from the ASIC 135. For example, the controller 130 control the operation of the conveying motor 102 to control rotations of the conveying motor 102 and the carriage motor 103. Further, the controller 130 controls the operation of the carriage motor 103 to reciprocally move the carriage 23. Further, the controller 130 controls the print head 39 to eject ink drops from the nozzles 40. Further, the controller 130 causes the display unit 14 to display messages and/or animations.

To the ASIC 135, the registration sensor 120, the rotary encoder 121 and the tray sensor 125 are connected. The controller 130 detects a location of the sheet 12 based on the signal output by the registration sensor 120 and the pulse signal output by the rotary encoder 121. The controller 130 detects whether the sheet 12 is present or absent on the MP tray 31 based on the signal output by the tray sensor 125. Further, the controller 130 obtains various instructions from the user through the console 17.

Hereinafter, referring to FIGS. 6-10, operations of the MFP 10 will be described. In the process described below may be realized as the CPU 131 retrieves the programs stored in the ROM 132, or realized by hardware circuits mounted on the controller 130.

Figure 6:
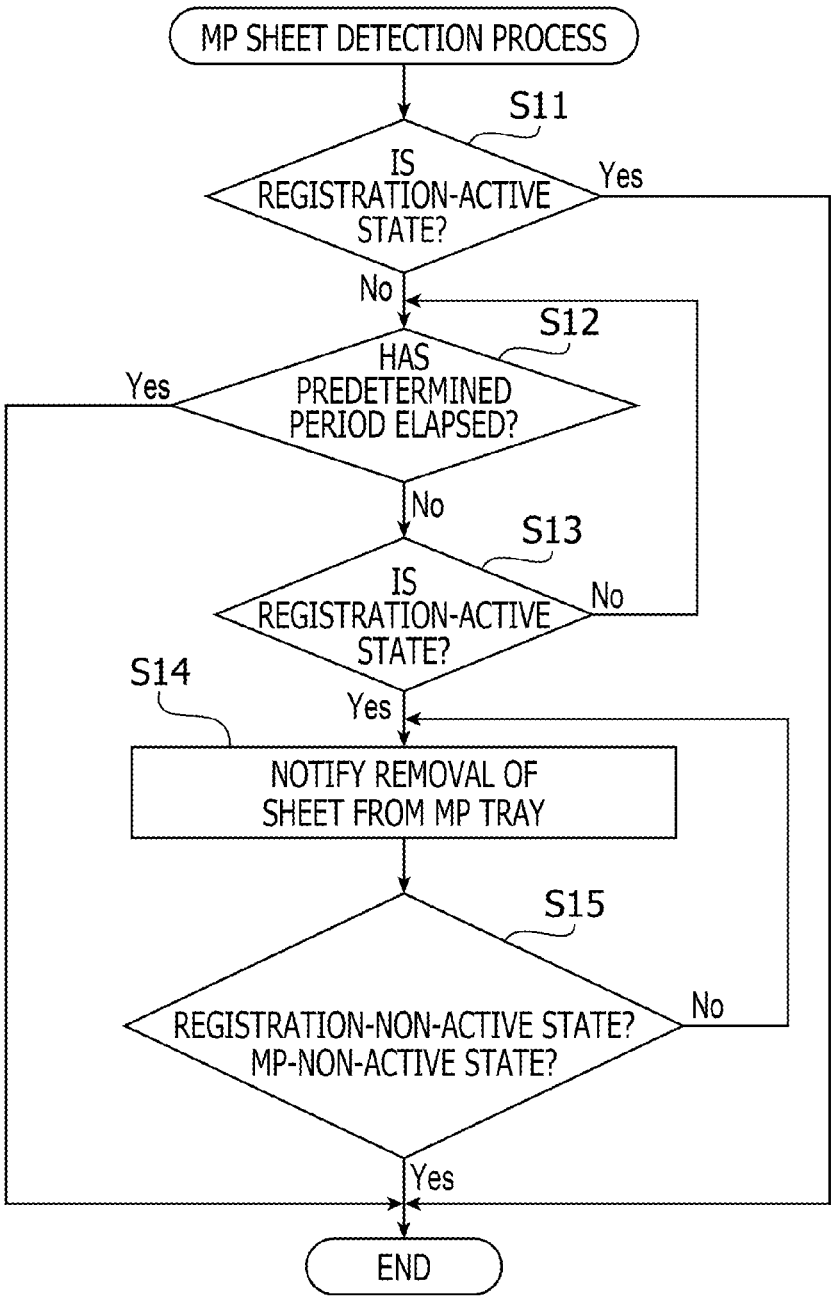
FIG. 6 is a flowchart illustrating an MP (multi-purpose) sheet detection process according to the illustrative embodiment of the disclosures.

Referring to FIGS. 6 and 7, an MP sheet detection process executed by the MFP 10 will be described. The MP sheet detection process is a process to detect whether sheets 12 are appropriately on the MP tray 31. The controller 130 executes the MP sheet detection process in response to a change of a state, when the MFP 10 is in a standby state, from an MP-non-active state to the MP-active state. It is noted that the standby state of the MFP 10 according to the illustrative embodiment is, for example, a state where the MFP 10 is not executing a printing process, a state where the conveying motor 102 stops, and the like.

Figure 9A:
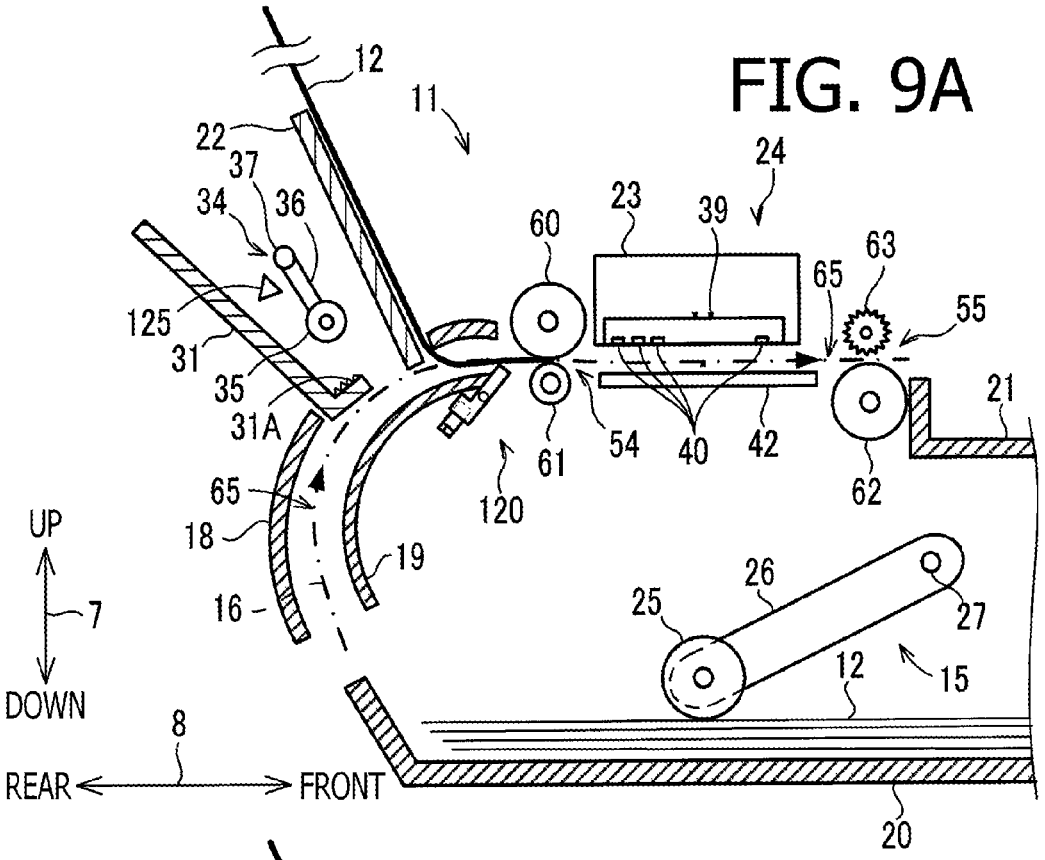
FIG. 9A shows a state where sheets are on a manual-feeding tray.
Figure 9B:
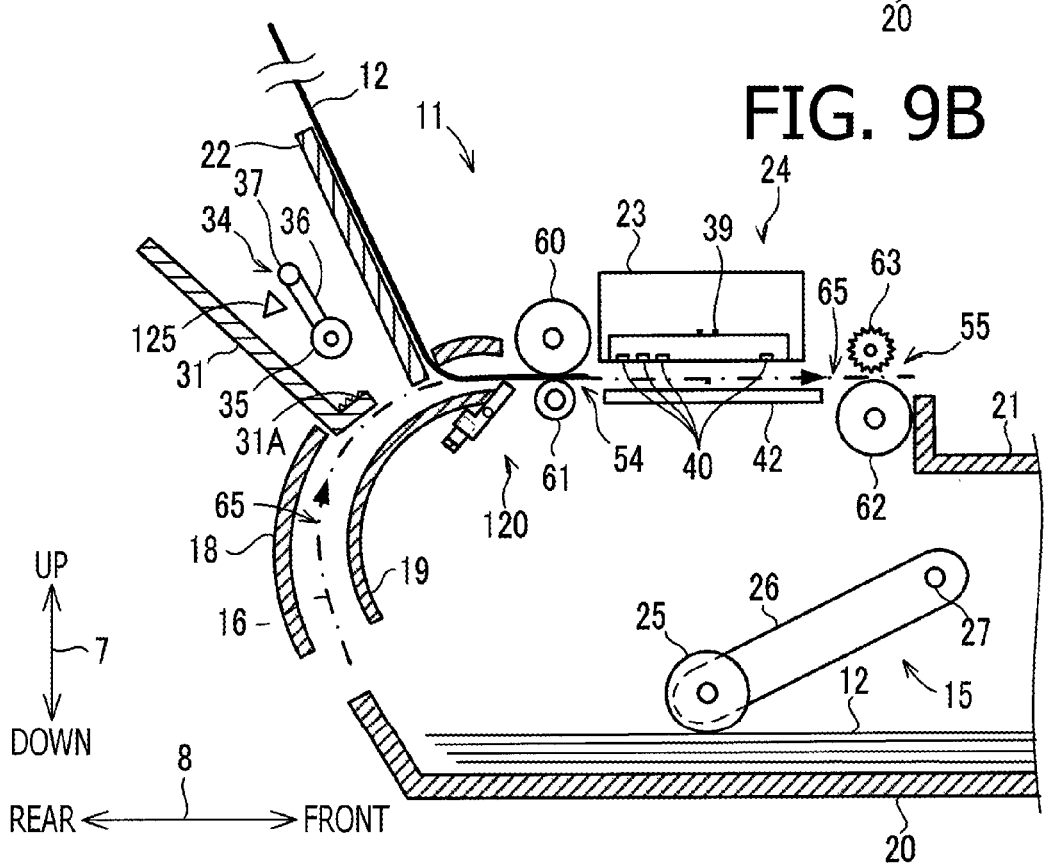
FIG. 9B shows a state where the sheets on the manual-feeding tray are nipped by a conveying roller unit.

When the state of the MFP 10 is changed from the MP-non-active state to the MP-active state, in response to the registration-active state (S11: YES), the controller 130 terminates the MP sheet detection process. In such a situation, for example, the user placed the sheets 12 on the MP tray 31 when the sheet 12 has already been placed on the manual-feeding tray 22 as shown in FIG. 9B. On the other hand, when the state of the MFP 10 is changed from the MP-non-active state to the MP-active state, in response to the registration-non-active state (S11: NO), the controller 130 pauses it operation until the threshold period passes or the registration-non-active state is changed to the registration-active state (S12, S13).

Figure 7A:
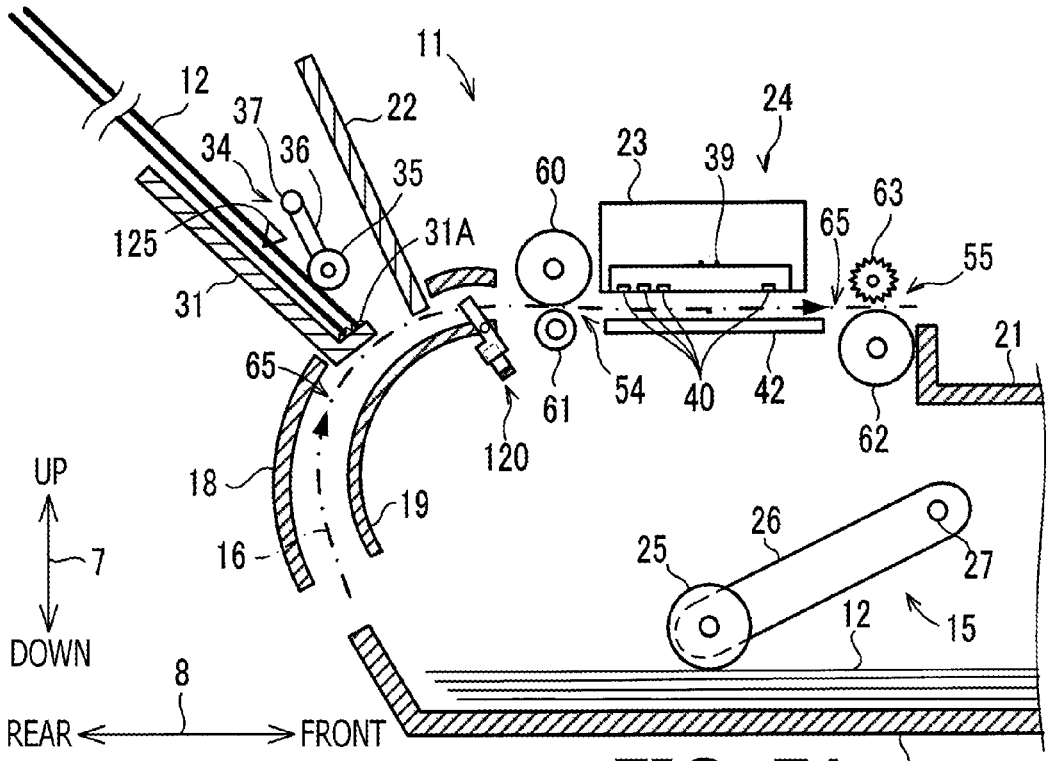
FIG. 7A shows a state where sheets are on a multi-purpose tray appropriately.

When the predetermined threshold period has passed with the registration-non-active state being kept (S13: NO and S12: YES), the controller 130 terminates the MP sheet detection process. In such a situation, for example as shown in FIG. 7A, the sheets 12 placed on the MP tray 31 by the user are considered to be appropriately placed on the MP tray 31. It is noted that a situation where the sheets 12 are not appropriately supported by the MP tray 31 is a situation, for example, where the leading end of the sheet 12 has not reached to the detection position of the registration sensor 120, and may contact the separation piece 31A.

Figure 7B:
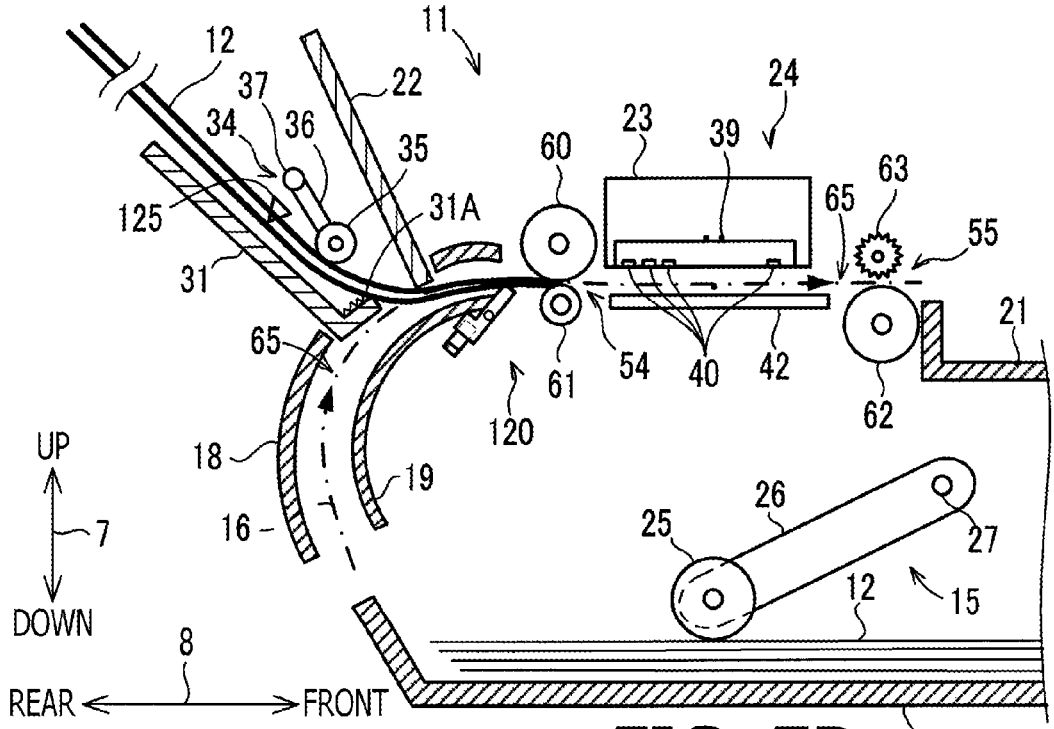
FIG. 7B shows a state where the sheets on the multi-purpose tray inadvertently reach a registration sensor.

When the registration-non-active state has changed to the registration-active state before the predetermined threshold period has passed (S12: NO, and S13: YES), the controller 130 notifies the user to encourage to remove the sheets 12 on the MP tray 31 (S14). In this situation, for example as shown in FIG. 7B, the sheet 12 placed on the MP tray 31 by the user moves over the separation piece 31A and has reached the detection position of the registration sensor 120. The process in S14 is an example of a removal notifying process. The method of the notification needs not be limited to a specific one. For example, the notification may a message or animation displayed on the display unit 14, or may be notified as an audio guidance output through a speaker provided to the MFP 10.

Until the state of the registration sensor 120 is changed from the registration-active state to the registration-non-active state and the MP-active state to the MP-non-active state (S15: NO), the controller 130 repeatedly executes the removal notifying process. When the state is changed to the registration-non-active state and the MP-non-active state (S15: YES), the controller 130 terminates the MP sheet detection process. This change of the state corresponds, for example, to a case where the sheets 12 inserted as shown in FIG. 7B are removed. Alternatively, the controller 130 may terminates the MP sheet detection process in response to change of the state of the registration sensor 120 from the registration-active state to the registration-non-active state with the MP-active state being maintained. This change of the state corresponds, for example, to a case where the sheets 12 inserted as shown in FIG. 7B is withdrawn such that the leading ends of the sheets 12 are located on the upstream side, in the conveying direction 16, with respect to the detection position of the registration sensor 120 (e.g., located on a position where the leading ends of the sheet 12 contact the separation piece 31A).

Next, referring to FIGS. 8, 9A and 9B, a manually-insertion print preparation process executed by the MFP 10 will be described. The manually-insertion print preparation process is to bring the sheet 12 placed, by the user, on the manual-feeding tray 22 in a condition where the printing process to print images on the sheets 12 can be executed. The controller 130 executes the manually-insertion print preparation process in response to the change of the state of the registration sensor 120 from the registration-non-active state to the registration-active state when the MFP 10 is in the standby state.

At a point of time when the state of the registration sensor 120 is changed from the registration-on-active state to the registration-active state, when the state of the tray sensor 125 is the MP-non-active state, the controller 130 executes a nipping process (S18). This situation corresponds, for example, to a case where the sheet 12 placed, by the user, on the manual-feeding tray 22 has reached the detection position of the registration sensor 120 when no sheet 12 is on the MP tray 31 as shown in FIG. 9A. The nipping process is, as shown in FIG. 9B, a process to cause the conveying roller 60 and the pinch roller 61 to nip the sheet 12 which in contact with the conveying roller unit 54. The controller 130 keeps rotating the conveying motor 102 forwardly until the number of the pulses included in the pulse signal output by the rotary encoder 12 reaches the threshold value.

At a point of time when the state of the registration sensor 120 is changed from the registration-non-active state to the registration-active state, when the tray sensor 125 is in the MP-active state (S16: YES), in response to elapse of a threshold period since the state of the tray sensor 125 was turned to the MP-active state (i.e., the MP-active state has been maintained for the threshold period) (S17: YES), the controller 130 executes the nipping process (S18). This state corresponds, for example, the sheet 12 is placed on the manual-feeding tray 22 by the user when, as shown in FIG. 7A, the sheet 12 is appropriately supported on the MP tray 31.

When the threshold period has not elapsed since the state of the tray sensor 125 was changed to the registration-active state (S17: NO), the controller 130 terminates the manually-insertion print preparation process without executing S18.

Figure 10A:
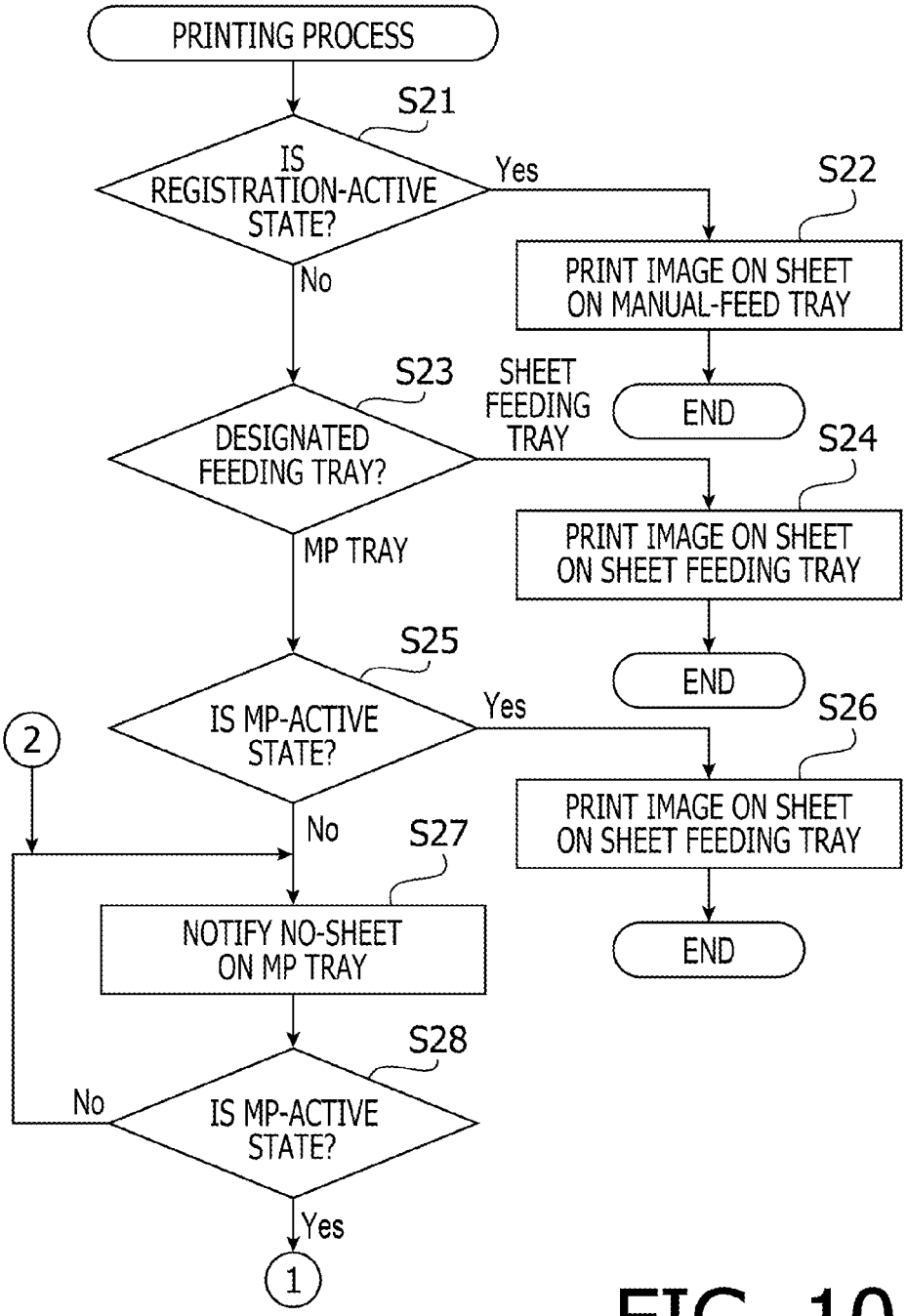
FIGS. 10A and 10B show a flowchart illustrating a printing process according to the illustrative embodiment of the disclosures.
Figure 10B:
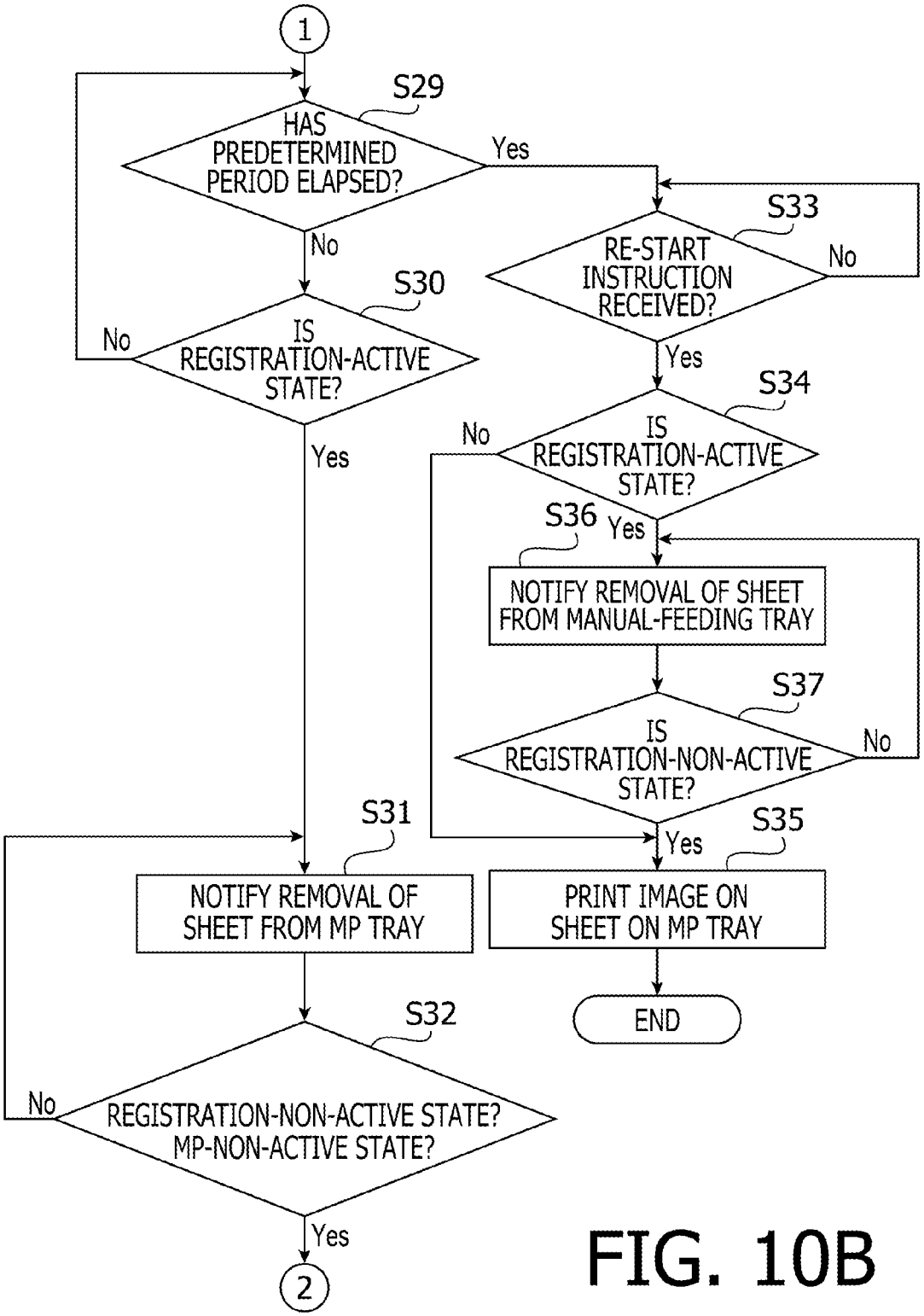

Referring to FIGS. 10A and 10B, a printing process of the MFP 10 will be described. The printing process is for printing an image on the sheet 12 supported on the feeding tray 20, the manual-feeding tray 22 or the MP tray 31. In response to receipt of print instruction (an example of a receiving process), the controller 130 starts the printing process. There is no particular requirement as to a resource of the print instruction. For example, the print instruction may be obtained through the console 17, or from an external device by way of a communication interface. According to the illustrative embodiment, the print instruction includes image data representing an image to be printed on the sheet 12 and a tray data representing a tray from which the sheet 12, on which the image represented by the print instruction is printed, is fed. According to the illustrative embodiment, the tray may be the feeding tray 20 or the MP tray 31.

At a point of time when the controller 130 receives the print instruction, when the registration sensor 120 is in the registration-active state (S21: YES), the controller 130 prints an image on the sheet 12 supported on the manual-feeding tray 22. It is noted that the sheet 12 supported on the manual-feeding tray 22 has already been nipped by the conveying roller 60 and the pinch roller 61 during the nipping process. In S22, the controller 130 controls the conveying roller unit 54 and discharge roller unit 55 to convey the sheet 12 in the conveying direction 16, and controls the printing mechanism 24 to selectively eject ink drops onto the sheet 12. Since the printing process is a well-known process, detailed description will be omitted for brevity.

At the point when the print instruction is received, when the registration sensor 120 is in the registration-non-active state (S21: NO) and the tray data designates the feeding tray 20 (S23: feeding tray), the controller 130 prints an image on the sheet 12 supported on the feeding tray 20 (S24). In S24, the controller 130 controls so that the sheet 12 supported on the feeding tray 20 reaches the conveying roller unit 54 by causing the carriage 23 to move the switching lever 176 to the first position and forwardly rotating the first feeding roller 25. The remaining step is common to S22.

Further, when the tray data designates the MP tray 31 (S23: MP tray) and the tray sensor 125 is in the MP-active state (S25: YES), the controller 130 prints an image on a sheet 12 supported on the MP tray 31 (S26) (an example of a printing process).

When the tray sensor 125 is in the MP-non-active state (S25: NO), the controller 130 notifies that there is no sheet 12 on the MP tray 31 (S27). At this stage (i.e., in S27), the controller 130 may be configured to encourage the user to place supplemental sheets 12 on the MP tray 31. A method of the notification may be the same as in S14. The controller 130 repeatedly executes a process of notifying no sheet (an example of a first notifying process) (S27) until the state of the tray sensor 125 is changed from the MP-non-active state to the MP-active state (S28: YES) or the print instruction is cancelled. It is noted that cancellation of an instruction is a well-known operation and description thereof will be omitted for brevity.

When, after execution of S27, the state of tray sensor 120 is changed from the MP-non-active state to the MP-active state (S28: YES), and the state of the registration sensor 125 is changed from the registration-non-active state to the registration-active state before the threshold period has elapsed after the state of the tray sensor 120 is changed to the MP-active state (S29: NO; S30: YES), the controller 120 notifies that that the sheets 12 on the MP tray 31 should be removed (S31).

Then, the controller 130 repeatedly executes the removal notification process (an example of the second notifying process) until the state of the registration sensor 120 is changed from the registration-active state to the registration-non-active and the state of the tray sensor 125 is changed from the MP-active state to the MP-non-active state (S32: NO). When the state of the registration sensor 120 becomes the registration-non-active state and the state of the tray sensor 125 becomes the MP-non-active state (S32: YES), the controller 130 re-executes the no-sheet notifying process (S27).

When the registration-non-active state is kept and the threshold period has passed (i.e., when the state of the registration sensor 120 is not changed from the registration-non-active state to the registration-active state before the threshold period has passed after the state of the tray sensor 125 is changed from the MP-non-active state to the MP-active state) (S30: NO, S29: YES), the controller 130 pauses its operation until the re-start instruction is input by the user through the operation unit 17 (S33). Such a situation occurs when the sheets 12 the user placed on the MP tray 31 are appropriately supported on the MP tray 31 as shown in FIG. 7A. It is noted that the re-start process is to re-start the operation of printing images on the sheets 12 in accordance with the print instruction. It is noted that the re-execution instruction may be obtained from an external device through the communication unit.

At a point of time when the re-start instruction is received (S33: YES), when the state of the registration sensor 120 is the registration-non-active (S34: NO), the controller 130 prints an image of the sheet 12 supported on the MP tray 31 (S35) (an example of a re-start the printing process). In this case, the sheets 12 are appropriately supported on the MP tray 31 and no sheet 12 is supported on the manual-feeding tray 22. The operation executed in S35 is the same as that in S26 as shown in FIG. 7A.

At a point of time when the re-start instruction is received (S33: YES), when the registration sensor 120 is in the registration-active state (S34: YES), the controller 130 notifies that the sheet 12 supported on the manual-feeding tray 22 should be removed (S36) (an example of a third notifying process). This situation corresponds to a case, for example, where the user places the sheet 12 on the manual-feeding tray 22 around a timing when the re-start instruction is input although the sheet 12 is appropriately supported on the MP tray 31.

The controller 130 repeatedly executes a re-start time sheet removal notifying process until the state of the registration sensor 120 is changed from the registration-active state to the registration-non-active state (S37: NO) or until the print instruction is cancelled. When the state of the registration sensor 120 is changed from the registration-non-active state to the registration-active state (S37: YES), the controller 130 prints an image on the sheet 12 supported on the MP tray 31 (S35). The processes executed in S35 are common to those in S26.

According to the above-described illustrative embodiment, it is detected that the sheet 12 passes over the MP tray 31 and reaches the arranged position of the registration sensor 120, and thus, it is possible to encourage the user to remove the sheet 12. As a result, if the registration sensor 120 is in the registration-active state when the MFP 10 is in the standby state, it can be judged that the sheet 12 is on the manual-feeding tray 22. As above, by monitoring absence/presence of the sheet 12 on each tray, it becomes possible to convey the sheets 12 appropriately. It is noted that the threshold period is determined by taking a time period necessary for the sheet 12 placed on the MP tray 31 by the user reaches the arranged position of the registration sensor 10, passing the separation piece 31A (e.g., approximately 0.5-2 seconds).

In particular, when a plurality of sheets 12 on the MP tray 31 reach the conveying roller unit 54 in overlaid state, and if the conveying roller unit 54 is driven without execution of the MP sheet detection process, the plurality of sheets 12 are conveyed in the overlaid state. Thus, the MP sheet detection process described above is particularly effective when executed to a tray which is configured to support a plurality of sheets 12 in a stacked manner. It is noted that the above does not prevent the MP sheet detection process from being executed with respect to a tray which is configured to support only a single sheet 12 at a time.

According to the above-described illustrative embodiment, feeding of the sheet 12 from a tray which is different from the tray designated by the tray data can be prevented. For example, it is possible that the sheet 12 deeply inserted in the MP tray 31 is incorrectly recognized as the sheet 12 supported on the manual-feeding tray 22 and the conveying operation is incorrectly executed. As a result, the sheet 12 can be conveyed to a correct position, and it is suppressed that an image is printed on a sheet 12 of different size and/or different types (e.g., normal sheet, glossy sheet, etc.) due to the incorrect recognition. Thus, deterioration of quality of printed image can be suppressed.

Figure 8:
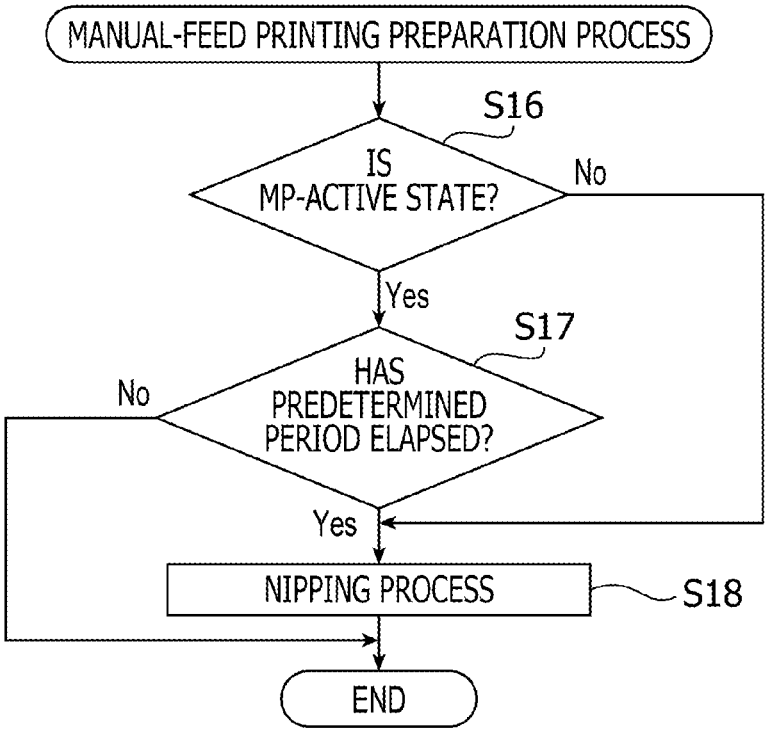
FIG. 8 is a flowchart illustrating a manual-feeding print preparation process for a manually-inserted sheet.

Although not shown in the drawings, the controller 130 may be configured to notify that the sheet 12 is appropriately placed on the MP tray 31 and/or the manual-feeding tray 22 in the processes shown in FIGS. 6, 8 and 10. With such a configuration, it is possible to let the user, who placed the sheets 12, recognize the placement condition of the sheets 12. Thus, lowering of throughput due to execution of the printing process with inappropriate placement state of the sheets 12 can be suppressed.

For example, when the registration-active state is kept until the threshold period has elapsed since the state of the tray sensor 125 is turned to the MP-active state in the MP sheet detection process (S13: NO, S12: YES), the controller 130 may notify that the sheets 12 are appropriately placed on the MP tray 31. For another example, the controller 130 may notify that the sheet 12 is appropriately placed on the manual-feeding tray 22 immediately before or after S18 of FIG. 8. For a further example, when the registration-non-active state is kept until the threshold period has elapsed since the tray sensor 125 is turned to the MP-active state in the printing process (S30: NO, S29: YES), the controller 130 may notify that the sheets 12 are appropriately placed on the MP tray 31 in the printing process.

In the above-described illustrative embodiment, when the print instruction with respect to the sheet 12 on the MP tray 31 is input when there is no sheet 12 on the MP tray 31, the printing process for the sheets 12 supported on the MP tray 31 is re-started in response to placement of the sheets 12 on the MP tray 31 and input of the re-start instruction (S28: YES, S29: YES, S33: YES). It is noted that the input of the re-start instruction may be omitted. That is, printing of the image (S35) on the sheet 12 supported on the MP tray 31 may be executed in response to detection of the appropriate placement of the sheets 12 on the MP tray 31. In such a case, steps S34, S35 and S37 may be omitted.

In the illustrative embodiment, removal of the sheets 12 supported on the MP tray 31 is notified in S14 or S31. The operation of the controller 130 needs not be limited to one as described. For example, a sheet discharging process to simply discharge the sheets 12 supported on the MP tray 31 may executed together with or instead of the notification. When such a discharging process is executed, the controller 130 may forwardly rotate the conveying motor 102 to cause the conveying roller 60 and the discharging roller 62 to discharge the sheets 12. It is note that at a time when the above discharging process is started, the registration sensor 120 is in the registration-active state, it is sufficient the controller 130 may forwardly rotate the conveying motor 102 until the state of the registration sensor 120 is changed from the registration-active state to the registration-non-active state. It is preferable to further rotate the conveying motor 102 forwardly by an amount which causes the trailing end of the sheet 12 to pass the discharging roller 62 after the state of the registration sensor 120 is changed from the registration-active state to the registration-non-active state.

In the above description, as an example of a conveying device of an image printing apparatus, the MFP 10 having the printer 11 employing the inkjet printing method is described. It is noted that the present disclosures should not be limited to the described MFP 10. For example, the configuration described above may be applied to another printing apparatus such as a laser beam printer. Further, the configuration described above may be applied to a feeder of feeding original sheets employed in an image scanning apparatus.

What is claimed is:

1. A conveying apparatus, comprising:

a conveyor configured to convey a sheet in a conveying direction;

a first tray arranged upstream, in the conveying direction, of the conveyor and configured to support the sheet thereon;

a second tray arranged upstream, in the conveying direction, of the conveyor and configured to support the sheet which is in contact with the conveyor;

a feeder configured to feed the sheet on the first tray toward the conveyor;

a first sensor configured to output a first signal in response to the sheet being present on the first tray;

a second sensor configured to output a second signal in response to the sheet being present between the first tray and the conveyor and configured to output the second signal in response to the sheet being present between the second tray and the conveyor; and a controller configured to receive both of output of the first signal and output of the second signal and configured to execute a removal notifying process to output a notification indicating removal of the sheet on the first tray when the first signal has been output and in response to output of the second signal before a time period since the first signal was output exceeds a threshold period.

2. The conveying apparatus according to claim 1, wherein the conveyor is configured to nip and convey the sheet, and wherein the controller is configured to operate the conveyor and configured to execute a nipping process, which operates the conveyor to nip the sheet on the second tray, when the first signal has been output and in response to output of the second signal after the time period exceeds the threshold period.

3. The conveying apparatus according to claim 2, wherein the controller executes the nipping process in response to output of the second signal, and the first signal not being output at a time when the second signal is output.

4. The conveying apparatus according to claim 1, wherein the feeder comprises;

a feed roller configured to feed at least one sheet on the first tray toward the conveyor; and a separation mechanism configured to separate one sheet from the plurality of sheets fed by the feed roller.

5. The conveying apparatus according to claim 1, wherein each of the first tray and the second tray is configured to support the sheets in an inclined state.

6. A printing apparatus, comprising:

a conveyor configured to convey a sheet in a conveying direction;

a first tray arranged upstream, in the conveying direction, of the conveyor and configured to support the sheet thereon;

a second tray arranged upstream, in the conveying direction, of the conveyor and configured to support the sheet which is in contact with the conveyor;

a feeder configured to feed the sheet on the first tray toward the conveyor;

a first sensor configured to output a first signal in response to the sheet being present on the first tray;

a second sensor configured to output a second signal in response to the sheet being present between the first tray and the conveyor and between the second tray and the conveyor;

a printing mechanism configured to print an image on the sheet conveyed by the conveyor;

a controller configured to receive both of output of the first signal and output of the second signal and configured to operate the feeder, the conveyor, and the printing mechanism based on the first signal and the second signal, the controller configured to execute;

a receiving process to receive a print instruction which instructs printing of an image on a sheet corresponding to the sheet on the first tray;

a first notifying process to notify that a sheet is not on the first tray in response to the first signal not being output when the controller receives the print instruction; and a second notifying process, to output a notification indicating removal of the sheet on the first tray, in response to the first signal having been output after execution of the first notifying process and the second signal having been output before a period of time since the first signal was output exceeds the threshold period.

7. The printing apparatus according to claim 6, wherein the controller is configured to further execute:

a printing process to print an image on the sheet on the first tray by operating the feeder, the conveyor and the printing mechanism in accordance with the received print instruction; and an interruption process to interrupt the printing process in response to the first signal not being output when the controller receives the printing instruction.

8. The printing apparatus according to claim 7, wherein the controller is configured to re-start the printing process based on the print instruction in response to a time period after only the first signal was output without the second signal being output exceeding the threshold period.

9. The printing apparatus according to claim 8, wherein the controller is configured to execute:

a third notification process notifying that the sheets on the second tray should be removed in response to the second signal being output when the printing process, which has been interrupted, is restarted; and the printing process in response to the second signal not being output after execution of the third notification process.

* * * * *